United States Patent [19]

Camp

[11] 4,354,616

[45] Oct. 19, 1982

[54] ALTERNATE COLUMN CIRCUIT RECIPROCATOR FOR MULTIPLE COLUMN VENDING MACHINES

[75] Inventor: Vernon D. Camp, Chattanooga, Tenn.

[73] Assignee: Cavalier Corporation, Chattanooga, Tenn.

[21] Appl. No.: 204,715

[22] Filed: Nov. 6, 1980

[51] Int. Cl.[3] ..... G07F 11/00

[52] U.S. Cl. ..... 221/116; 221/129; 194/2

[58] Field of Search ..... 194/1 R, 2, 10; 221/112, 114, 116, 117, 118, 123, 124, 129, 67

[56] References Cited

U.S. PATENT DOCUMENTS

| | | | |
|---|---|---|---|
| 2,585,011 | 2/1952 | Johnson | 221/118 X |
| 3,040,928 | 6/1962 | Levine | 221/116 |
| 3,107,030 | 10/1963 | Taylor | 221/116 |
| 3,125,245 | 3/1964 | Newberry | 221/114 |
| 3,158,289 | 11/1964 | Van Brunt | 221/116 |
| 3,240,386 | 3/1966 | McCloy | 221/116 |
| 3,252,617 | 5/1966 | Ficken | 221/129 |
| 3,349,881 | 10/1967 | Camp | 194/10 |
| 3,486,601 | 12/1969 | Bowman | 194/10 |
| 3,498,497 | 3/1970 | Baxendale et al. | 221/116 |
| 3,756,362 | 9/1973 | Pearce | 221/129 |
| 3,904,076 | 9/1975 | Payne | 221/116 |
| 3,924,779 | 12/1975 | Lindsey | 221/67 |
| 4,044,877 | 8/1977 | Burton | 194/10 |
| 4,220,235 | 9/1980 | Lindsey et al. | 194/10 |
| 4,232,689 | 11/1980 | Nagasaka et al. | 221/129 X |

*Primary Examiner*—Joseph J. Rolla

*Attorney, Agent, or Firm*—Kerkam, Stowell, Kondracki & Clarke

[57] ABSTRACT

A circuit reciprocator or alternator arrangement for alternately operating two vend motor-driven stack mechanisms loaded with the identical product brand from a single common customer-operable selector switch. An on-on type switch having SPDT contacts for alternately completing a circuit to the two vend motors is operated by an actuating linkage. The linkage is arranged such that switching or toggling of the on-on switch occurs prior to a particular known point or range of points of the vend cycle where the probability of a mechanism jam is higher. Therefore, if one of the vend motors jams, the circuit has already been completed to the other vend motor which can then be subsequently actuated. Further, the on-on switch is geld in a position where no furhter toggling or switching occurs, and the circuit will continue to be completed to the other, unjammed motor. The linkage is further arranged such that no damage occurs when one motor is stalled and the other continues to operate.

4 Claims, 4 Drawing Figures

ALTERNATE COLUMN CIRCUIT RECIPROCATOR FOR MULTIPLE COLUMN VENDING MACHINES

BACKGROUND OF THE INVENTION

The present invention relates generally to money operated vending machines and, more particularly, to a multiple column or source machine wherein two stacks loaded with the identical product brand are alternately operated from the same selector switch.

Money operated vending machines for selectively dispensing articles, one at a time, from a plurality of sources are well known. Such vending machines generally comprise a plurality of stacks of articles which may be arranged in columns in side by side or front to back relationship. Upon insertion of the proper amount of money, such as deposit of a suitable coin, credit is established and a dispensing cycle is initiated according to a selection by the customer. In one particular type of machine, a vend motor is cycled during the dispensing cycle and causes a single article to be dispensed from the selected column or source.

In a multiple stack machine, it is sometimes desired to limit the number of actual selections available to the customer by enabling a prime product to be loaded into two stacks controlled by a single customer-operated selector switch, with the two stacks dispensing alternately as the selector switch is operated. This is commonly done to assure a prime product of getting its proper space in the vendor.

By way of particular example, a mechanical mechanism for alternately dispensing articles from a pair of stacks is disclosed in commonly-assigned Payne U.S. Pat. No. 3,904,076. Electrical alternator circuits for the same purpose have also been proposed, for example as are disclosed in Levine U.S. Pat. No. 3,040,928, McCloy U.S. Pat. No. 3,240,386 and Ficken U.S. Pat. No. 3,252,617. In each of the systems disclosed in these three patents, some form of SPDT switch automatically alternates between individual electrically-operated dispensing mechanisms to alternately operate the mechanisms upon actuation of a single manually-operated switch. By way of further example, the Pearce U.S. Pat. No. 3,756,362 discloses a related arrangement wherein a stepping relay sequentially energizes a number of individual vending mechanisms.

In such vending machines, it sometimes happens that a motor-driven vending mechanism stalls or jams during an attempted dispensing of an article. More specifically, under such conditions one of the vend motors does not complete its cycle of operation, and an associated cam-operated switch does not return to its resting condition. In such event, it is highly desirable that the machine not be fully disabled, and that the remaining product selections remain operative. In view of this, typical prior art vending machine circuits and mechanisms allow alternative selection of articles when one selection is stalled or jammed. Exemplary circuits for use in machines of the type wherein dispensing from each column is controlled by a vend motor arranged to be energized during the latter (vending) portion of its vend cycle through a cam-operated timer switch are disclosed in the following commonly-assigned U.S. Pats.: Camp, No. 3,349,881, Bowman, No. 3,486,601, and Lindsey et al, No. 4,220,235.

It is also desirable to provide a similar feature where two columns are alternately operated from a single selector switch. In other words, if the vend mechanism of one of the two interconnected columns stalls or jams, it is desirable that the alternating operation end and that all remaining vending be accomplished from the non-jammed product selection until all articles are sold out. In accordance with the present invention, this particular problem is recognized, and a highly effective solution provided.

SUMMARY OF THE INVENTION

Accordingly, it is an object of the invention to provide an alternator or reciprocator system for alternately operating two vend motor-driven stack mechanisms from a single selector switch.

It is another object of the invention to provide such a system which, in the event of a jam or stalling of the mechanism driven by one of the motors, the other motor and mechanism are repeatedly operated, and the alternating operation terminated.

It is still another object of the invention to provide such features in a reliable and inexpensive manner, requiring minimal modifications to existing designs.

Briefly stated, and in accordance with one aspect of the invention, these and other objects are satisfied by a circuit reciprocator for alternately selecting between two separate sources in the vending machine having at least a pair of sources of articles adapted to be selectively dispensed and at least a pair of vend motors, with each vend motor corresponding to a separate source and arranged to operate during a vend cycle to drive a mechanism for dispensing an article from the corresponding source when energized. With typical mechanisms, the probability of a mechanism jam occurring is higher at a particular known point or range of points of the vend cycle. In other words, there is a particular point or range of points where a jam or stall, if it occurs, is likely to have occurred.

The circuit reciprocator of the invention includes a more-or-less conventional customer-operable selector switch common to the two article sources. In accordance with the invention, an on-on type switch has an actuating member movable between first and second positions and operable each time the actuating member is moved from the first to the second position to alternately complete either of a pair of respective electrical energizing circuits between the common selector switch and each of the pair of vend motors. A typical such switch has a reciprocally-movable plunger-type actuating member, and an SPDT contact arrangement. The on-on type switch latches in either position, thus exhibiting a "memory" characteristic, and changes or toggles from one position to the other each time the plunger is depressed from its first to its second position. In order for another change or toggle to occur, the plunger must be allowed to return to its first or non-actuated position.

In addition to the conventional vend mechanisms driven by the vend motors, there are a pair of rotatable cams respectively driven by each of the pair of vend motors when energized. An actuating linkage is connected between the cams and the on-on switch actuating member, the actuating linkage arranged such that either of the pair of cams can effect movement of the on-on switch actuating member from the first to the second position at a predetermined point of the vend cycle, thereby to complete the circuit to the other of the pair of vend motors so that the other vend motor is energized upon the next operation of the customer-operable selector switch. Thus, during normal operation, the vend motors are alternately operated through successive vend cycles as the selector switch is successively operated and the on-on switch is toggled from one position to the other.

For the possible event that one of the vend motors is stalled or jammed in a position where its cam is at its predetermined point where the on-on switch actuating member is moved to its second position, and the other vend motor continues to be operable, the actuating linkage is further arranged such that both of the cams may simultaneously be at their respective predetermined points of their respective vend cycles without damage to the circuit reciprocator. For example, this may be accomplished by means of a resilient element, such as a rubber bushing or a spring, included in the actuating linkage and positioned so as to the form when both of the cams are simultaneously at their predetermined points of their respective vend cycles. Alternatively or in addition, the particular on-on type switch employed may be one which permits overtravel beyond the second position to accommodate both of the cams being simultaneously at their predetermined points of their respective vend cycles.

Additionally, the cams are positioned and configured such the on-on switch actuating member is moved from the first to the second position prior to the particular point in the vend cycle where the probability of a mechanism jam is higher, and the cams each have dwell at least sufficient to hold the actuating member in the second position as motor and cam rotation proceed further to the point or range of points where a mechanism jam is likely to have occurred in the event a mechanism jam occurs.

As a result, in the event a mechanism jam occurs during the vend cycle of one of the pair of vend motors, the on-on switch will already have been toggled to its other position where the circuit is completed to the other vend motor. Therefore, the other of the pair of vend motors can continue to operate through successive vend cycles as the selector switch is successively operated. Since the actuating member of the on-on switch is held in its second position (or beyond, if overtravel is permitted), and does not return to the first position, the on-on switch is not again toggled and further attempts at operating the jammed vend motor are not made.

BRIEF DESCRIPTION OF THE DRAWINGS

While the novel features of the invention are set forth with particularity in the appended claims, the invention, both as to organization and content, will be better understood and appreciated along with other objects and features thereof, from the following detailed description taken in cojunction with the drawings, in which:

DETAILED DESCRIPTION OF THE PREFERRED EMBODIMENT

Figure 1:
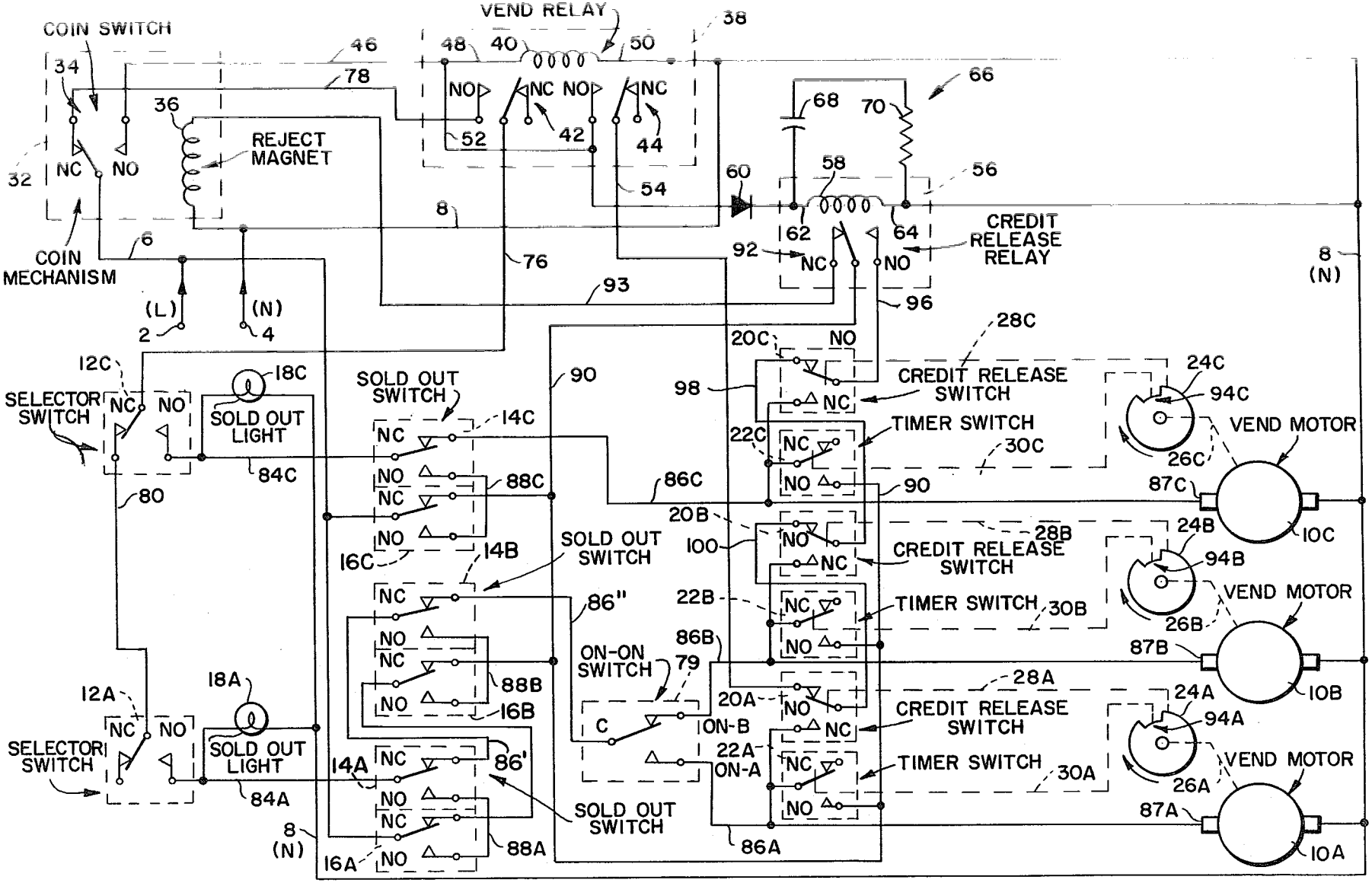
FIG. 1 is an electrical schematic circuit diagram of a complete vending machine control circuit, including a circuit reciprocator for alternately selecting between two separate sources in accordance with the present invention.
Figure 2:
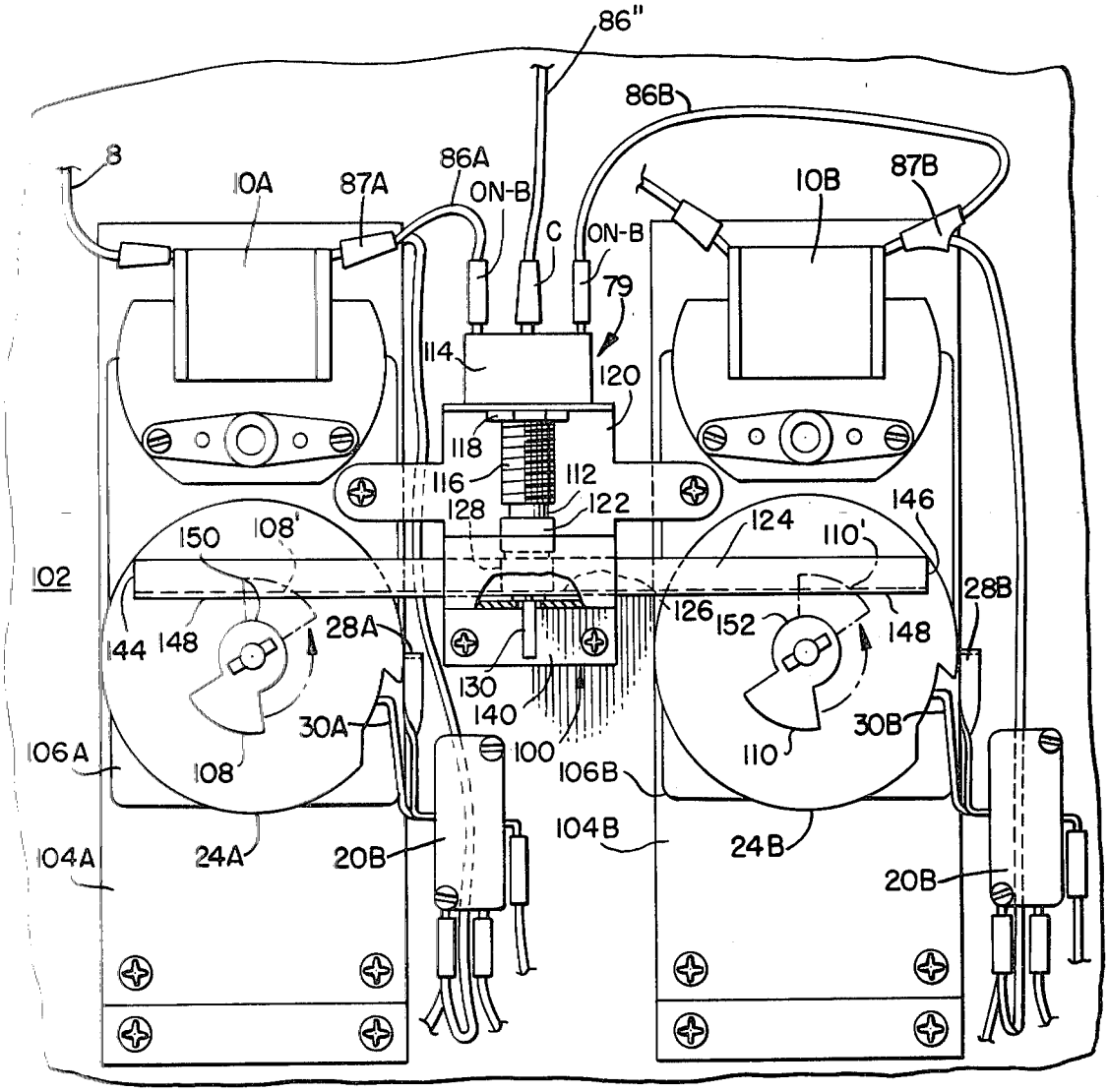
FIG. 2 is a front elevational view of a pair of interconnected vend motors with an actuating linkage.
Figure 3:
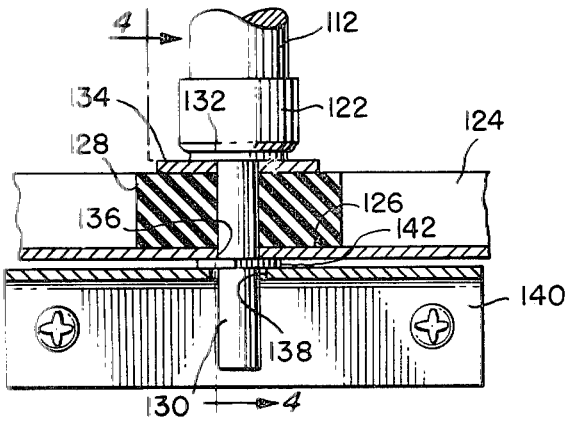
FIG. 3 is an enlarged view, partly in cross section of a portion of FIG. 3.
Figure 4:
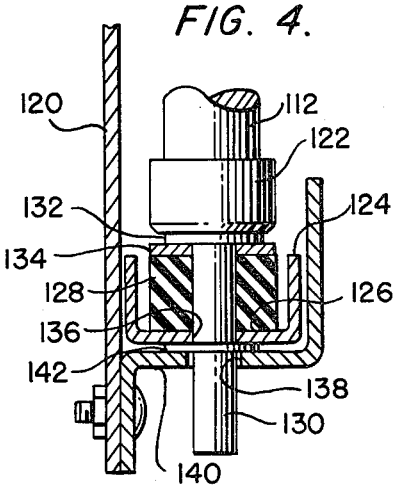
FIG. 4 is a section taken along line 4—4 of FIG. 3.

Since the inventive concept of the invention resides in an improved circuit and actuating mechanism, and is substantially independent of the cabinet in which it is located or the means for delivery of the article which is dispensed, so long as vend motors are employed, the invention is herein described with reference only to FIG. 1 showing an electrical schematic diagram and to FIGS. 2, 3 and 4 showing mechanical elements important to an understanding of the invention. By way of example, one particular vending machine cabinet in which the circuit of the present invention may be employed is disclosed in the commonly-assigned Lindsey U.S. Pat. No. 3,924,779, the entire disclosure of which is hereby incorporated by reference.

The basic vending machine control circuit with which the present invention is employed is that which is disclosed in another above-mentioned commonly-assigned Lindsey et al U.S. Pat., No. 4,220,235, the entire disclosure of which is also hereby expressly incorporated by reference. It will, however, be appreciated that the present invention may readily be employed in conjunction with a variety of basic vending machine control circuits, and there is accordingly no intention to limit the invention either to application in combination with the particular basic circuit illustrated, or to the particular embodiment illustrated.

Referring now to FIG. 1 in detail, the circuit shown is for a coin-operated vending machine having three columns or sources of articles designated A, B and C. In this particular machine, columns A and B are interconnected in accordance with the invention so as to be alternately operated from a single customer selector switch, while column C is a single, independent column having its own customer selector switch.

It will be apparent that as few as two or any greater number than three columns or article sources may be utilized and that the operating sequence for dispensing an article from each source is essentially the same. For convenience, each component in the operating circuit of one article column corresponding to a like component in the operating circuit of the other columns is designated with a like numerical reference character (e.g., 10, 12, 14, etc.) followed by an alphabetical reference character (A, B or C) designating the particular source with which the component is associated. However, in the written description herein the numerical reference characters are generally employed alone and intended to refer collectively to the like components.

The illustrated circuit is adapted for operation from a conventional 120 Volt, 60 Hz AC supply connected to respective Line (L) and Neutral (N) supply terminals 2 and 4. However, with suitable component selection, the illustrated circuit will operate from a D.C. supply as well, as may be seen from the circuit disclosed in the above-incorporated Lindsey et al U.S. Pat. No. 4,220,235 which operates from a twenty-four volt D.C. source. For convenience, a line 6 which is supplied from the (L) terminal 2 is referred to herein as a "hot" conductor, and a line 8 which is supplied from the (N) terminal 4 is referred to herein as a "ground" or "return" conductor.

For effecting dispensing, each column has associated therewith a vend motor 10 which dispenses selected articles in a manner which is described in the above-incorporated Lindsey U.S. Pat. No. 3,924,779. (As noted above, in the nomenclature employed herein, since there is a separate vend motor for each article column, the individual vend motors are designated 10A, 10B and 10C in FIG. 1. For each vend cycle in which a single article is dispensed, the appropriate vend motor causes (through reduction gearing) a single 360° cam and mechanism rotation before returning to a rest position. However, with suitable additional cam cutouts, a 180° rotation may readily be achieved as is required for some dispensing mechanisms. In such event, the reciprocator of the present invention can optionally be arranged to alternate either after two dispensing operations from a single column (after 360° of rotation) or after a single dispensing operation (after 180° of rotation).

For initial energization of the appropriate one of the vend motors 10, a customer-operable selector switch 12 is generally associated with each article column. However, since the columns A and B are interconnected in accordance with the invention, they share a single selector switch 12A.

Other components associated with each article column, the connections to which are described in greater detail hereinafter, are a sold out switch having first and second double-throw sections 14 and 16 each arranged to be switched from the normally-closed (NC) position illustrated to the normally-open (NO) position upon exhaustion of the article supply in the corresponding column, a sold out light 18, a cam-operated credit release switch 20, and a cam-operated timer switch 22. The cam-operated switches 20 and 22 are arranged to be actuated by the corresponding motors 10 by means of motor-driven cams 24 which are driven by the corresponding vend motors 10 via reduction gearing represented by dash lines 26, and which cams 24 effect actual operation of the credit release switches 20 and the timer switches 22 through mechanical connections represented by respective dash lines 28 and 30.

The circuit additionally has a number of common components which are shared by all of the columns or sources. Specifically, there is a convention coin mechanism 32 which includes a coin-operated vend switch or coin switch 34 having a common terminal connected to the hot line 6, a normally-closed (NC) contact terminal, and a normally-open (NO) contact terminal. In operation, upon insertion of the proper amount of money, the vend switch or coin switch 34 momentarily switches to its normally-open (NO) position, and then returns to the normally-closed (NC) position illustrated. The coin mechanism 32 additionally includes a conventional coin reject electromagnet 36 which, when energized, permits the acceptance of money to actuate the vend switch 34 and, when de-energized, prevents the acceptance of money. It will be appreciated that the coin mechanism 32 may be a conventional coin operated device adapted to receive coins of greater value than the cost of the article to be selected, and to dispense change accordingly, while momentarily closing the normally-open (NO) contacts when the proper amount of coins is received, and thereafter returning the contacts to their original position.

An additional element common to the various article columns is a conventional vend relay 38 including an operating coil 40 and contact sections 42 and 44.

To energize the vend relay 38 upon insertion of money, the normally-open (NO) terminal of the vend switch 34 is connected via a line 46 to an energization terminal 48 of the vend relay coil 40, and the other terminal 40 of the vend relay coil 40 is connected to the ground return line 8.

For establishing a holding circuit for the vend relay 38 upon initial energization thereof, the normally open (NO) terminal of the vend relay contact section 44 is connected via a line 52 to the vend relay energization terminal 48, while the common terminal of the vend relay contact section 44 is supplied by a line 54 which, in a manner hereinafter described, is energized through the credit release switches 20 at appropriate times.

A credit release relay 56 includes an operating coil 58 which is energized when the vend relay 38 is energized. More particularly, a circuit for energizing the credit release relay 56 when the vend relay 38 is energized includes a connection through an isolation and rectifier diode 60 between the vend relay coil energization terminal 48 and an energization terminal 62 of the credit release relay coil 58. To complete the circuit, the other terminal 64 of the credit release relay coil 58 is connected to the ground return line 8.

A time delay circuit 66 includes a storage capacitor 68 connected in parallel with the coil 58 of the credit release relay 56 to maintain the credit release relay 56 energized for a predetermined time interval after the vend relay 38 is de-energized. In order to better control the discharge characteristics of the capacitor 58, a current-limiting resistor 70 in interposed in series therewith. Depending upon the internal resistance of the credit release relay coil 58, the resistor 70 may or may not be necessary.

In the operation of the time delay circuit 66, when the vend relay 38 is energized, voltage across the coil 40 thereof is additionally supplied through and rectified by the isolation diode 60 to energize the credit release relay coil 58. This rectified voltage additionally charges the storage capacitor 68. Upon subsequent de-energization of the vend relay 38, and more particularly of the coil 40 thereof, voltage is no longer supplied from the vend relay 38 to the credit release relay coil 58 and the storage capacitor 68. The capacitor 68 discharges at a predictable rate through the current limiting resistor 70 and the credit release relay coil 58, thus maintaining the credit release relay 56 in an energized condition until insufficient charge remains in the capacitor 58. The isolation diode 50 serves to prevent discharge of the holding capacitor 68 into the vend relay coil 40, which discharge otherwise would cause a delay in the release of the vend relay 38 as well.

The components associated with each of the individual article columns will now be described in greater detail. In order to supply the selector switches 12 with power when the vend relay 38 is energized, the common terminal of the vend relay contact section 42 is connected via a line 76 to the selector switches 12, and the normally-open (NO) terminal of the vend relay contact section 42 is connected, in an "anti-jackpot" feature, via the line 78 to the normally-closed (NC) contact terminal of the vend switch 34. Thus voltage from the hot line 6 is supplied through the vend relay contact section 42 to the line 76 and the selector switches 12 only after the coin switch or vend switch 34 has returned to the normally-closed (NC) position illustrated.

The particular arrangement of the selector switches 12 is such that upon simultaneous customer operation of a plurality of the selector switches 12 only one selector switch energizes its corresponding vend motor 10, or, in accordance with the present invention, the particular vend motor 10 to which a circuit is completed through an on-on type switch 79. To this end, the line 76 supplies the selector switches 12 in serial fashion. Specifically, the common terminal of the selector switch 12C is directly supplied from the line 76, and the common terminal of the selector switch 12A is supplied via a line 80 from the normally-closed (NC) terminal of the selector switch 12C. Thus if more than one selector switch 12 is operated at a time, only the higher one in the chain remains supplied with power. While only two selector switches, 12A and 12C are shown, switch 12A being common to both columns A and B through the on-on switch 79, the chaining principle may readily be extended.

In the particular connection, referred to above, of each selector switch 12 to energize the corresponding vend motor 10 when operated while supplied with power, in general the normally-open (NO) terminal of each of the selector switches 12 is connected via a line 84 to the common terminal of the corresponding sold out switch first section 14, and then from the switch section 14 normally-closed (NC) terminal via a line 86A, 86B or 86C directly to an energization terminal 87 of the corresponding vend motor 10. To complete this energization circuit, the other terminals of the vend motors 10 are connected directly to the ground return line 8.

However, in the particular arrangement of the present invention, the selector switch 12A is common to the two vend motors 10A and 10B, with a circuit from the common selector switch 12A being alternately completed to the vend motors 10A and 10B through the on-on type switch 79, which in this particular embodiment has a simple SPDT contact arrangement, with latching in either position as discussed above under the heading "Summary of the Invention". The on-on switch 79 completes a circuit from its common (C) terminal to either its ON-A or ON-B terminal, with connection to the ON-B terminal being shown in FIG. 1. It is actually the ON-A and ON-B terminals which respectively are connected directly to the motor lines 86A and 86B, with the sold out switch sections 14A and 14B connected in series via lines 84A, 86' and 86". Line 86" is connected to the on-on switch 79 common (C) terminal.

In the event a particular column is sold out, then the contact sections 14 and 16 of the associated sold out switch are in the normally-open (NO) position. When this occurs, the connection between the lines 84 and 86 is broken such that the corresponding vend motor 10 cannot operate when the selector switch 12 is operated, and the corresponding sold out light 18 is energized from the hot line 6 through a path including the now-closed normally-open (NO) contacts of the second sold out switch section 16, a line 88, and the now-closed normally-open (NO) contacts of the first sold out switch section 14. Due to the series connection of the sold out switch sections 14A and 14B, if either of the columns or sources "A" or "B" is sold out, the common sold out light 18A is energized, and the connection to the on-on switch 79 and thus to both vend motors 10A and 10B is broken.

An additional function of the sold out switch second sections 16 is to supply a line 90, common to all article selections, which is connected to the common terminal of the credit release relay contacts 92. The normally-closed (NC) contact terminals of the second sold out switch sections 16 are generally connected in parallel (but sections 16A and 16B in series with each other) such that the line 90 is supplied from the hot line 6 so long as at least one of the article sources is not exhausted and the corresponding sold out switch remains in the normally-closed (NC) position, and power is removed from the line 90 when the vending machine is completely sold out.

To energize the reject electromagnet 36 (permitting the acceptance of money) when the credit release relay 56 is de-energized, a line 93 connects the credit release relay 56 normally-closed (NC) contact terminal to the reject electromagnet 36. This particular connection ensures that the reject electromagnet 36 cannot be energized when the machine is entirely sold out and power is removed from the line 90.

The cam-operated credit release switches 20 and the cam-operated time switches 22, identical in the case of each vend motor 10, will now be considered in greater detail. Both of these switches 20 and 22 are for convenience operated from the single cam 24 via the mechanical links represented at 28 and 30. Each of the cam-operated switches has a normally-closed (NC) position which occurs when the appropriate mechanical link 28 or 30 is in a corresponding cam notch 94, and has a normally-open (NO) position which occurs when the mechanical link 28 or 30 is on the high part of the cam 24. In the "at rest" position illustrated in FIG. 1, the mechanical links 28 of the credit release switches 20 are all on the high parts of the corresponding cams 24, and the credit release switches 20 are accordingly in the normally-open (NO) position, hereinafter referred to as a first position of each of the credit release switches 20. In the "at rest" position, the mechanical links 30 of the timer switches 22 are in the notches 94 of the cams 24 such that the timer switches 22 are all in the normally-closed (NC) position, hereinafter referred to as the first position of the timer switches 22.

Each of the credit release switches 20 is arranged to be actuated by its corresponding vend motor 10 via the cam 24 and link 28 between the normally-open (NO) or first position illustrated and a momentary normally-closed (NC) or second position which occurs shortly after initial energization of the corresponding vend motor 10 by the corresponding selector switch 12. The credit release switches 20 are all initially supplied with power when the credit release relay 56 is energized and the credit release relay contacts 92 switch to their normally-open (NO) position whereby a line 96 is supplied with power from the line 90. This supplies power to the common terminal of the credit release switch 20C uppermost in the illustration, which switch, via a series arrangement of the normally open (NO) contacts of the credit release switches 20, supplies power to the remaining credit release switches 20.

In the normally-open (NO) or first credit release switch position shown in the drawing, a continuous conductive path may be traced from the credit release relay contacts 92 through the line 96, through the credit release switch 20C, through a line 98, through the credit release switch 20B, through a line 100, and then through the credit release switch 20A to the previously-mentioned line 54 which supplies the vend relay 38 holding circuit. Thus when the credit release switches 20 are all in the first position as illustrated, the vend relay 38 holding circuit is energized, awaiting actual energization of the vend relay 38 by the vend switch 34.

The contacts of each of the credit release switches 20 are additionally arranged in the momentary normally-open (NO) or second position to interrupt the vend relay holding circuit, allowing the vend relay 38 to become de-energized. Due to the series connection of the credit release switch normally-open (NO) contacts, switching of any one of the credit release switches 20 to the second position wherein the normally-closed (NC) contacts are open interrupts and the vend relay 38 holding circuit.

The switching of any one of the credit release switches 20 to the second position wherein the normally-closed (NC) contacts are closed additionally energizes the corresponding vend motor 10 so long as the particular credit release switch 20 remains supplied with power.

As a part of the circuit which ensures the delivery of only one article per vend switch 34 operation, at least one of the credit release switches 20 in its momentary second position wherein the normally-closed (NC) contacts are closed interrupts the supply of power to at least one other credit release switch 20, which may also be in its second position as a result of a customer attempt to obtain more than one article from the deposit of a single coin. By way of example, when the uppermost credit release switch 20C is in the second position wherein its normally-closed (NC) contacts are closed and its normally-open (NO) contacts are open, power from the line 96 to the line 98 is interrupted, and the two lower credit release switches 20B and 10A are no longer supplied with power. Accordingly these two lower credit release switches 20B and 20A do not energize their corresponding vend motors 10B and 10A even though they may also be in their second positions wherein the normally-closed (NC) contacts are closed.

The cam arrangement for the timer switches 22 is such that each of the timer switches 22 is actuated by its corresponding motor 10 from the first to the second position wherein the normally-open (NO) contacts are closed during the interval the corresponding credit release switch 20 is in its momentary second position energizing the corresponding vend motor 10. Each timer switch 22 is further arranged to be actuated from the second back to the first position at the end of an article vend cycle.

From the representative depiction of each of the cams 24, it will be seen that initially the representative links 28 are on the high part of the cams 24, and the mechanical links 30 are in the cam notches 94. Thus the credit release switches 20 are in the normally-open (NO) position (first position) and the timer switches 22 are in the normally-closed (NC) position (first position). When one of the vend motors 10 is energized and the corresponding one of the cams 24 rotates clockwise, almost immediately the corresponding mechanical link 28 enters the notch 94, while the mechanical link 30 initially remains in the notch 94. The credit release switch 20 thus switches to its second position wherein the normally-closed (NC) contacts are closed, while the timer switch 22 remains in the first position illustrated. As the cam 24 continues its clockwise rotation, the raised part of the cam reaches the mechanical link 30 which actuates the timer switch 22 to its second position wherein its normally-open (NO) contacts are closed. Shortly thereafter, the mechanical link 28 is also on the high part of the cam 24, and the credit release switch 20 returns to its first or normally-open (NO) switch position. At the end of a vend cycle, the link 30 of the timer switch 22 again enters the cam notch 94, terminating the vend cycle.

The normally-open (NO) contact terminals of each of the timer switches 22 are supplied from the line 90 which is directly connected via a sold out switch section 16 to the hot line 6 so long as at least one of the article sources is not yet exhausted. Accordingly, actuation of a timer switch 22 to the second position wherein its normally-open (NO) contacts are closed effects direct energization of the corresponding vend motor 10, which energization continues until the end of the vend cycle, whereupon the timer switch returns to its first position, de-energizing the vend motor 10.

As previously mentioned, the time delay circuit 66 maintains the credit release relay 56 energized for a predetermined time interval after the vend relay 38 holding circuit is interrupted and the vend relay 38 is de-energized. This predetermined time interval is at least long enough for whichever one of the timer switches 22 is active to switch to its second position and directly energize the corresponding vend motor 10, and short enough such that the credit release relay 56 is de-energized to remove the supply of power via the line 96 from all of the credit release switches 20 before the vend motor 10 corresponding to any other credit release switch which may be in its second position is energized sufficiently long to cause the corresponding other timer switch 22 to switch to second position.

In the overall general operation of the basic vending machine control circuit shown for purposes of example in FIG. 1, upon insertion of the correct amount of money, the vend switch or coin switch 34 momentarily switches to its normally-open (NO) position and momentarily energizes the vend relay 38 through the conductor 46. Power is additionally simultaneously supplied through the diode 60 to energize the credit release relay 56. The vend relay 38 holding circuit is thereby established, which holding circuit may be traced from the hot line 6, through any one of the sold out switch second sections 16, through the line 90, through the now-closed normally-open (NO) contacts 92 of the credit release relay 56, through the series connected credit release switches 20 through the line 54, and then through the now-closed normally-open (NO) contacts 44 of the vend relay 38.

Upon customer actuation of a single-column selector switch, for example the representative selector switch 12C, assuming the corresponding sold out switch 14C is in its normally-closed (NC) position, a direct energization path to the energization terminal 87C of the vend motor 10C is established. The cam 24C begins rotating in the clockwise direction as illustrated in the FIG. 1 orientation, and the credit release switch 20C almost immediately switches to its second position wherein the normally-closed (NC) contacts are closed. In this particular arrangement, it will be appreciated that the selector switch 12C must be held in its momentary normally-open (NO) position to energize the vend motor 10C until such time as the credit release switch 20C has switched to its second position.

At this point, the credit release switch 20C interrupts the vend relay 38 holding circuit as the credit release switch 20C normally-open (NO) contacts open. The vend relay 38 immediately returns to its de-energized condition, removing power from all of the selector switches 12 which are supplied through the line 76. Additionally, the credit release switch 20C switching to the second position interrupts the supply of power to the next lower credit release switch 20B, even though the credit release relay 56 remains energized due to the time delay circuit 66.

With further clockwise rotation of the cam 24C, the timer switch 22C switches to its second position wherein its normally-open (NO) contacts are closed. This establishes a direct energization path for the corresponding vend motor 10C, which rotates the cam 24C all of the way around until the timer switch 22C again returns to its first position and de-energizes the vend motor 10C.

In the meantime, the time delay circuit 66 de-energizes the credit release relay 56, whereupon the credit release relay 56 normally-closed (NO) contacts 92 again close, and the normally-open (NO) contacts open removing power from all of the credit release switches 20. This has the effect of removing established credit and readying the circuit to receive the next insertion of money.

Operation of those portions of the FIG. 1 circuit directly pertinent to the present invention is quite similar, except that the one selector switch 12A energizes either the vend motor 10A or the vend motor 10B, depending upon the contact position of the on-on switch 79.

Specifically, upon customer actuation of the common customer-operable selector switch 12A, assuming both of the series-connected sold out switch sections 14A and 14B are in their normally-closed (NC) positions, a direct energization path through the on-on switch 79 to one of energization terminals 87A or 87B of the vend motors 10A or 10B is established. In the particular on-on switch 79 position illustrated, it is the vend motor 10B which is energized. In a manner essentially identical to that described above concerning the exemplary energization of the vend motor 10C, the cam 24B begins rotating in the clockwise direction as illustrated, and the credit release switch 20B almost immediately switches to its second position wherein the normally-closed (NC) contacts are closed. Operation continues as described above, except it is the credit release switch 20B and timer switch 22B which function during the resultant vend cycle.

In a manner hereinafter described in greater detail with particular reference to FIGS. 2, 3 and 4, during operation of the vend motor 10B to cause its associated mechanism to vend an article from source "B", the on-on switch 79 is switched or toggled to its other position so that the other vend motor 10A can be energized upon the next subsequent actuation of the customer-operable selector switch 12A. As discussed above, an identical product, typically a prime product, is loaded into both the "A" and "B" article sources, and, upon successive actuations of the selector switch 12A, the vend motors 10A and 10B are repeatedly operated until either column "A" or column "B" is sold out.

From the general operation of this circuit as described above, only a momentary operation of the selector switch 12A is required to initiate a vend cycle, and thereafter it is the cam-operated timer switch 22A or 22B which maintains energization of the particular vend motor 10A or 10B through the entire vend cycle. Similarly, once a vend cycle comprising energization of one of the vend motors 10A or 10B is initiated, the on-on switch 79 may be switched or toggled to its other position, readying an initial energization path for the other of the vend motors 10A and 10B, while the one of the vend motors 10A or 10B continues to complete its vend cycle. This is an important aspect of the circuit operation in the event one of the vend motors 10A or 10B stalls or jams during a vend cycle.

In particular, and again as more fully explained herein below with particular reference to FIGS. 2, 3 and 4, the arrangement for actuating the on-on switch 79 toggles this switch 79 prior to the particular known point or range of points in the vend cycle where the probability of a mechanism jam is higher such that, in the event a jam occurs, the on-on switch 79 will already have been switched to a position where the non-jammed vend motor 10 can be energized. Further, the arrangement is such that, in the event a stall or jam occurs, further switching of the on-on switch 79 does not occur, thereby maintaining the energization path to the non-jammed vend motor 10, and precluding subsequent attempts at energizing the jammed vend motor 10.

The basic circuit of FIG. 1 also deals effectively with various abnormal conditions, as explained in detail in the above-incorporated commonly-assigned Lindsey et al U.S. Pat. No. 4,220,235. For example, during a mechanism jam wherein a vend motor 10 is stalled, the basic circuit must continue to be operational. A jam is accomodated by the basic circuit in the following manner: Since actual product dispensing occurs after the timer switch 22 switches to its second position and the credit release switch 20 returns to its first position, a jam during product vending affects only the article column or source corresponding to that one particular vend motor 10. Once the credit release switch 20 has returned to its first position wherein its normally-open (NO) contacts are again closed and the time delay circuit 66 allows the credit release relay 56 to de-energize, the basic circuit is again ready to accept additional money and permit other article selections. If the jammed motor is either of the vend motors 10A or 10B controlled through the on-on switch 79, the other of the vend motors 10A or 10B is free to operate as previously explained.

Further, in the event a jam occurs, a subsequent customer is warned not to select the stalled article source. For example if it is a non-prime article source which is jammed (e.g., the single vend motor 10C controlled by the single selector switch 12C), the sold out light 18C is energized through the timer switch section 22C, the line 86C, the first sold out switch section 14C, and the line 84C.

However, in the case of a jam of one of the article sources "A" and "B" having the circuit reciprocator arrangement of the present invention wherein a non-jammed article source mechanism can continue to operate even though the other article source mechanism is jammed, it is not desired that the common sold out light 18A be energized if only one of the selections is jammed and the other remains free to operate. This result is obtained in the subject circuit because, in order for the common sold out light 18A to be energized during an intermediate portion of the vend cycle, and particularly during a jam or stall condition, the energizing voltage must be supplied from one of the two timer switches 22A or 22B and one of the two lines 86A and 86B through an energizing path comprising the on-on switch 79, a line 86'', and the series-connected first sold out switch sections 14B and 14A to the line 84A. However, once the on-on switch 79 is switched or toggled to its other position, which action occurs prior to the particular known point in the vend cycle where the probability of a mechanism jam is higher, the line 86'' connected to the common (C) terminal of the on-on switch 79 is no longer supplied with power. Therefore, the energizing path through the series-connected first sold out switch sections 14B and 14A to the line 84A is no longer energized.

In the event the second of the two interconnected vend motors 10A and 10B also jams, then the common sold out light 18A does illuminate, warning a subsequent customer not to operate the common selector switch 12A.

As also described in the above-incorporated Lindsey et al U.S. Pat. No. 4,220,235, the basic circuit of FIG. 1 includes protection against multiple product selection after a single insertion of money, and reference may be had to the Lindsey et al U.S. Pat. No. 4,220,235 for details of this particular operation, which is not affected by the modifications of the present invention.

With reference now to FIGS. 2, 3 and 4, there are shown details of an actuating linkage, generally designated 100, for effecting actuation of the on-on switch 79 in the manner described somewhat functionally hereinabove.

FIG. 2 depicts in physical form various of the components illustrated merely schematically in FIG. 1. Specifically, in FIG. 2 are shown the two vend motors 10A and 10B interconnected through the subject circuit reciprocator, the motor-driven cams 24A and 24B, the cam-operated credit release switches 20A and 20B, as well as the on-on switch 79. In the particular orientation illustrated in FIG. 2 it should be noted the cams 24A and 24B rotate counterclockwise during a vend cycle, compared to clockwise rotation in the FIG. 1 orientation. FIG. 2 is a front elevational view wherein the cam-operated credit release switches 20A and 20B are visible, but wherein the cam-operated timer switches 22A and 22B (FIG. 1) are hidden behind the credit release switches 20A and 20B. From FIG. 2, it may be seen that these cam-operated switches comprise Microswitches®, actuator arms 28 and 30 comprising the mechanical connections being represented by respective dash lines 28 and 30 in FIG. 1. Omitted from FIG. 2 are the mechanical connections by which the vend motors 10A and 10B drive the actual dispensing mechanism in entirely conventional fashion.

FIG. 2 is intended to primarily depict the physical and mechanical arrangements of the various elements and, accordingly, the actual electrical interconnections of FIG. 1 are largely omitted. However, several of the connections or lines are shown, for example the line 86" leading to the on-on switch 79 common (C) terminal, and the lines 86A and 86B interconnecting the respective vend motors 10A and 10B with the on-on switch 79 terminals ON-A and ON-B.

The various elements of FIGS. 2, 3 and 4 are mounted to a suitable base 102, to which are secured vend-motor mounting plates 104. In conventional configuration, the vend motors 10 are connected to the cams 24 through suitable speed-production gears contained within gear housings 106A and 106B fastened to the mounting plates 104, these corresponding to the FIG. 1 links 26.

In addition to the prior art cams 24 for actuating the credit release switches 20 and the timer switches 22 (FIG. 1 only), there are provided a pair of rotatable cams 108 and 110 respectively driven by the vend motors 10A and 10B when energized, the cams 108 and 110 conveniently being driven by the same geared-down shaft which drives the cams 24A and 24B.

The on-on timer switch 79 may in FIGS. 2, 3 and 4 more particularly be seen to comprise a plunger type switch having an actuating member 112 movable between first (extended) and second (retracted) positions. As discussed hereinabove, the on-on switch 79 is operable each time the actuating member or plunger 112 is moved from the first (extended) to the second (retracted) position to alternately complete either of a pair of respective electrical energizing circuits comprising the conductors 86A and 86B connected to the vend motors 10A and 10B as described hereinabove with reference to FIG. 1. More particularly the on-on switch 79 has a body portion 114 and an externally threaded projecting sleeve 116 through which the plunger 112 passes and which cooperates with a nut 118 to secure the on-on switch 79 to a suitable bracket 120 extending between the two gear housings 106A and 106B. An enlarged head 122 is fitted to the plunger 112.

The actuating linkage 100 comprises a bar 124 of U-channel configuration engaging the head 122 of the on-on switch 79 plunger 112 generally on one surface 126 at an intermediate point of the bar 124. This engagement is not direct, but rather is through an interposed resilient bushing 128 secured by a loosely-fitting pin 130 having a head 132 engaging a washer 134. As is best seen in FIGS. 3 and 4, the pin 130 extends through an aperture 136 in the U-channel bar 124 and through another aperture 138 in a bracket 140 fastened to the lower end of the bracket 120. The bushing 128 and pin 130 are secured to the U-channel linkage bar 124 by means of an annular snap ring 142.

The two cams 108 and 110 are positioned near respective ends 144 and 146 of the U-channel linkage bar 124 for engagement with an undersurface 148 of the U-channel linkage bar 124 opposite the upper surface 126.

The physical arrangement of the elements is such that either of the cams 108 and 110 when rotated counterclockwise to the position shown in phantom at 108' and 110', respectively, causes movement of the switch 79 plunger 112 from the first to the second position at a point on the vend cycle predetermined to be prior to a particular known point or range of points of the vend cycle where the probability of a mechanism jam is higher. As one end of the bar 124 is raised by either of the cams 108 or 110, the other end of the bar rests against a low point 150 or 152 of the opposite cam, allowing the intermediate point of the bar 124 to urge the plunger 112 upward.

In operation, therefore, assuming the vend motor 10A is energized and begins rotating the cams 24A and 108 counterclockwise, eventually the cam 108 engages the undersurface 148 of the linkage bar 124, forcing the end 144 upward and causing the switch 79 plunger 112 to be urged upward as the other end 146 of the bar 124 rests on the cam 110 low point 152. When the plunger 112 reaches the second position, actuation of the on-on switch 79 occurs, and the switch 79 switches or toggles to complete an energizing circuit from the common selector switch 12A (FIG. 1) to the other vend motor 10B, readying the other vend motor 10B for energization upon a subsequent customer actuation of the common selector switch 12A. Significantly, if a mechanism jam occurs, stalling the vend motor 10A, the on-on switch 79 will already have toggled or switched to the other vend motor 10B.

Further, the cam 108 positioning and dwell is such that, for likely positions of a mechanism jam, the switch plunger 112 is held in its second position (or even beyond depending upon the amount of overtravel inherent in this switch 79), thereby preventing further toggling of the switch 79 regardless of the operation of the other vend motor 10B and its associated cam 110.

Still further, the arrangement shown in FIG. 2 is constructed such that both of the cams 108 and 110 can be simultaneously at their predetermined points where engagement of the bar 124 results, without damage to any part of the arrangement. This is necessary to ensure that normal operation of an unjammed vend motor 10 can continue even though the other vend motor 10 is jammed.

This may be accomplished in a number of ways. For example, a deformable resilient element, such as the rubber bushing 128, may be provided which deforms to absorb the excess motion when both of the cams 108 and 110 are simultaneously at their predetermined points of their respective vend cycles. A compression spring will serve the same purpose.

Alternatively, or in addition, the on-on switch 79 internally permits over travel of the plunger 112 beyond the second position where actuation occurs, and this overtravel accomodates some or all of the excess motion when both of the cams 108 and 110 are at their predetermined points of their respective vend cycles.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A circuit reciprocator for alternately selecting between two separate sources in a vending machine having at least a pair of sources of articles adapted to be selectively dispensed and at least a pair of vend motors, each vend motor corresponding to a separate source and arranged to operate during a vend cycle to dispense an article from the corresponding source when energized, the probability of a mechanism jam occurring being higher at a particular known point of the vend cycle, said circuit reciprocator comprising:

a customer-operable selector switch common to the two article sources;

an on-on type switch having an actuating member movable between first and second positions and operable each time said actuating member is moved from the first to the second position to alternately complete either of a pair of respective electrical energizing circuits between said common selector switch and each of said pair of vend motors;

a pair of rotatable cams respectively driven by each of said pair of vend motors when energized; and an actuating linkage connected between said cams and said on-on switch actuating member, said actuating linkage arranged such that either of said pair of cams can effect movement of said on-on switch actuating member from the first to the second position at a predetermined point of the vend cycle thereby to complete the circuit to the other of said pair of vend motors so that the other vend motor is energized upon the next operation of said selector switch and vend motors are alternately operated through successive vend cycles during normal operation as said selector switch is successively operated, said actuating linkage further being arranged such that both of said cams may simultaneously be at their respective predetermined points of their respective vend cycles without damage to said circuit reciprocator, and said cams being positioned and configured such that said on-on switch actuating member is moved from the first to the second position prior to the particular known point in the vend cycle where the probability of a mechanism jam is higher, and said cams each having dwell at least sufficient to hold said actuating member in the second position in the event a mechanism jam occurs at the particular known point;

whereby in the event a mechanism jam occurs during the vend cycle of one of said pair of vend motors the other of said pair of vend motors can continue to operate through successive vend cycles as said selector switch is successively operated.

2. A circuit reciprocator according to claim 1, wherein said actuating linkage comprises a bar engaging said on-on switch actuating member on one surface and at an intermediate point of said bar, with said cams positioned near respective ends of said bar for engagement with an opposite surface of said bar.

3. A circuit reciprocator according to claim 1, wherein a resilient element is included in said actuating linkage and positioned so as to deform when both of said cams are simultaneously at their predetermined points of their respective vend cycles.

4. A circuit reciprocator according to claim 1, wherein said on-on type switch actuating member permits overtravel beyond the second position to accommodate both of said cams being simultaneously at their predetermined points of their respective vend cycles.

* * * * *